US005586482A

United States Patent [19]

Leonard

[11] Patent Number: 5,586,482

[45] Date of Patent: Dec. 24, 1996

[54] TWO-STAGE FLUIDIC ACTUATOR

[76] Inventor: W. Burt Leonard, Rt. 1, Box 254, Waller, Tex. 77484

[21] Appl. No.: 519,540

[22] Filed: Aug. 25, 1995

[51] Int. Cl.[6] ..... F15B 11/036

[52] U.S. Cl. ..... 91/519; 92/62

[58] Field of Search ..... 91/170 R, 178, 91/519; 92/62

[56] References Cited

U.S. PATENT DOCUMENTS

| | | | |
|---|---|---|---|
| 1,970,999 | 8/1934 | Ferris | 91/167 R |
| 3,018,762 | 1/1962 | Korb | 91/519 |
| 3,208,354 | 9/1965 | Topinka | 92/62 |
| 3,680,713 | 8/1972 | Langley | 92/62 |
| 4,341,147 | 7/1982 | Mayer . | |
| 4,638,718 | 1/1987 | Nakamura | 92/62 |
| 4,828,230 | 5/1989 | Steger et al. . | |
| 4,928,733 | 5/1990 | Sudolnik et al. . | |

*Primary Examiner*—F. Daniel Lopez
*Attorney, Agent, or Firm*—William A. Knox

[57] ABSTRACT

A fluidic actuator includes dual-element, differential area pistons consisting of a power piston and an extender piston that are mounted in a double-chamber cylinder. A spring-loaded throttling plunger is slidingly mounted in a longitudinal bore in the power piston to meter the flow of pressurized fluid against to the extender piston as a function of the incremental stroke length of the extender piston.

5 Claims, 3 Drawing Sheets

TWO-STAGE FLUIDIC ACTUATOR

BACKGROUND OF THE INVENTION

1. Field of the Invention

A two-stage hydraulically or pneumatically actuated piston for providing a variable thrust force as a function of piston rod extension.

2. Discussion of Related Art

Many machine applications require a very large initial breakaway force but with a much lesser force being needed later in an operating cycle. In an exemplary situation, such as encountered when using the Brush Clearing Device disclosed in co-pending U.S. patent application Ser. No. 08/383,011, filed Feb. 3, 1995, in the name of the inventor of this invention, and now U.S. Pat. No. 5,526,637. In that invention, a hinged-jaw assembly is secured to a load lifting means, such as a hydraulic piston, mounted on a farm tractor. The jaws of the assembly are caused to enclose a swath of brush in a tight embrace whereupon the hydraulic lifting means raises the jaw assembly to pull the brush out of the ground by the roots. Thereafter, the load is raised to a height to allow deposition of the uprooted brush in, for example, a stake-body truck. Uprooting the brush requires a great deal of initial force. But once the brush is plucked from the ground, while the force required to maneuver the load of brush above the truck bed is minimal, a considerable lift extension is needed.

Thus, there is a need for applying a large initial force over a short distance followed by subsequent application of a lesser force over a much longer distance.

FIG. 1 is a common form of a prior art device for accomplishing the above desideratum using a telescoping piston assembly. Either hydraulic or pneumatic power can be used to operate the piston. A large-area piston 10 is contained within a cylinder 12. Piston 10 includes a hollow piston rod 14. Hollow piston rod 14, in turn, becomes the cylinder for containing a second piston 16 whose exposed area is less than the area of piston 10. Piston rod 18 is secured to the device to be actuated. In operation, pressurized fluid that is applied through inlet port 20 first moves piston 10 to the end of its stroke, whereupon, piston 16 continues its extension until it abuts the end of hollow piston rod 14. To retract the pistons, if they are not to be retracted by gravity, hydraulic fluid must first be introduced through inlet port 22 to retract piston 10 and thereafter fluid must be introduced through inlet port 24 to retract piston 18, thus requiring a rather complex hydraulic circuit.

More than two nested pistons can be used if desired. Telescoping pistons are sometimes used in situations where the assembly must be relatively compact when the pistons are retracted but, nevertheless, a long stroke is needed.

The disadvantages to the arrangement of FIG. 1 are manifold. There are two or more polished exposed piston rods, 14 and 18, that must be protected from corrosive ambient environments. There are many surfaces that need to be polished and accurately concentered. Furthermore, the retraction operation is complicated by the requirement for at least two separate valving system, one for each piston 10 and 18, or more valving if multiple nested pistons are used.

U.S. Pat. No. 4,828,230 teaches a Dual Acting Hydraulic Actuator for Active Suspension System, issued May 9, 1989 to C. B. Stegar et al. The system provides an active suspension for vehicles with a dual acting hydraulic actuator providing for shortened overall length for a given amount of stroke. The cylinder tube of the actuator makes use of concentric tubes proportioned to provide the same pressure/force relationship in both directions. This case is cited to show a version of a telescoping actuator used to minimize the total length of the device for a preselected length of stroke.

U.S. Pat. No. 4,928,733, issued May 29, 1990 to J. M. Sudolnik et al. provides a Steam Valve with Variable Actuation Forces. This valve is essentially a dual element telescoping piston configured as a pilot valve that contacts a small-diameter valve seat which is operative during a cracking cycle in order to maintain positive control of the valve. Later a larger-diameter main valve is opened to reduce the actuation forces required beyond the cracking position. This reference is cited to show use of a telescoping piston to provide a variable force.

U.S. Pat. No. 4,341,147 issued Jul. 27, 1982 to R. E. Mayer for a Coaxial Hollow Piston Regenerative Liquid Propellant Gun, teaches use of a multi-element combustive/hydraulic gun-firing system which is essentially a complex version of the telescoping piston of FIG. 1 of this disclosure. The system includes a first coaxial pumping piston which is a differential area pressure piston operating between a combustion chamber and the primary propellant reservoir. A second coaxial piston in a bore in the first piston opens and closes injection ducts running through the pumping piston from the primary reservoir to the bore to interdict flow of propellant to the combustion chamber. This reference is cited to illustrate another application of telescoping coaxial pistons.

There is a need for a fluidic piston-type actuator of simple design that is capable of applying a force that is a function of the piston extension.

SUMMARY OF THE INVENTION

In accordance with this invention, there is provided a fluidic actuator including a dual-chamber cylinder body. The cylinder body includes a power chamber that opens into a superjacent extender chamber. The inner diameter of the extender chamber is less that the inner diameter of the power chamber but has a greater length. The junction between the two chambers forms a shoulder internally of the power chamber. A power piston is mounted for reciprocating motion in the power chamber. The power piston has a diameter commensurate with the inner diameter of the power chamber but has a reduced-diameter portion that reaches into a portion of the extender chamber. The power piston defines a posterior face, an intermediate face, an anterior face and includes a longitudinal bore through the piston. An extender piston, having a diameter commensurate with the internal diameter of the extender chamber is mounted for reciprocating motion in the extender chamber. The extender piston defines a posterior face and an anterior face. The posterior face of the extender piston is exposed to the anterior face of the power piston. Application of pressurized fluid to the posterior face of the power piston causes both pistons to jointly execute an initial extension until the intermediate face of the power piston contacts the shoulder in the power chamber. Thereafter, continued application of pressurized fluid through the bore in the power piston against the posterior face of the extender piston, causes the extender piston to execute a subsequent extension stroke. A spring-loaded throttling plunger is slidingly mounted within the longitudinal bore of the power piston. The throttling plunger controls the extension rate of the extender piston by adjusting the volumetric flow rate of pressurized fluid into the extender chamber as a function of the incremental stroke length. The two stage fluidic actuator optimizes the performance of a desired task by discretely apportioning the distribution of power between the thrust and stroke vectors as a function of the stroke length, during the task performance.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 2:
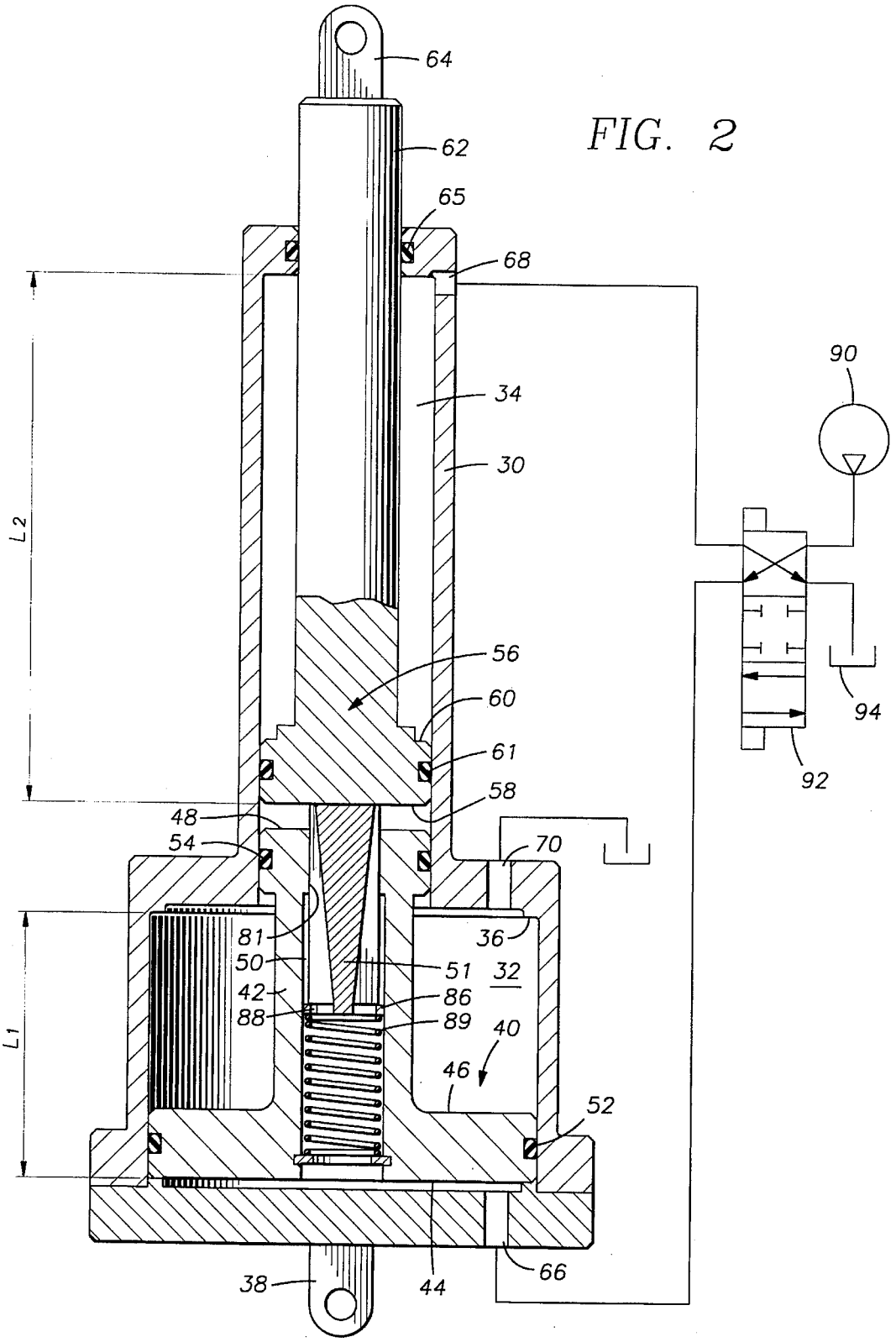
FIG. 2 is a drawing of the dual-chamber fluidic actuator of this invention in the retracted position.
Figure 3:
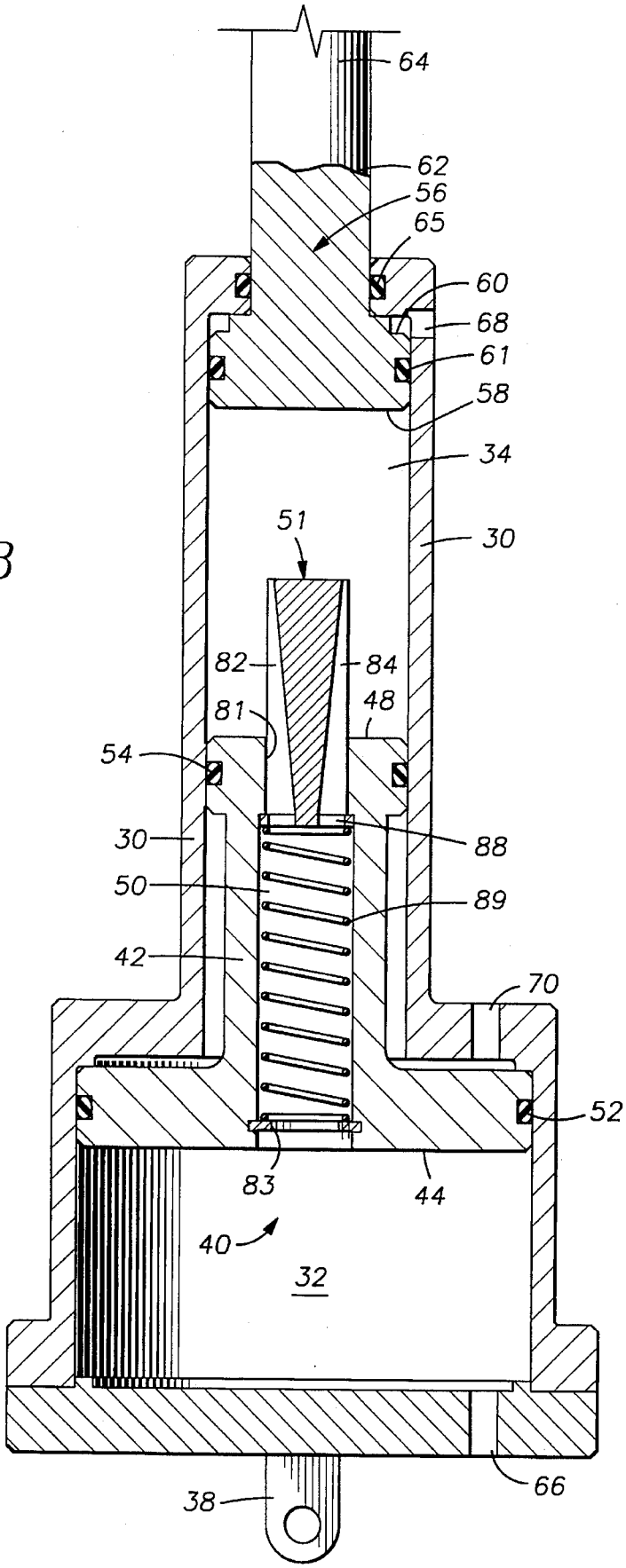
FIG. 3 shows the fluidic actuator in the extended position.

Please refer now to FIGS. 2 and 3 where there is shown the fluidic actuator of this invention in the retracted and extended positions respectively. The actuator consists of a dual-chamber cylinder body 30 including a power chamber 32 that has a first length $L_1$ and a superjacent coaxial extender chamber 34 having a second length $L_2$. The actual lengths of the respective chambers and the resultant stroke lengths, depends of course on the specific application of the actuator.

The inner diameter of extender chamber 34 is a preselected fraction, such as one-half, of the inner diameter of the power chamber 32. A shoulder 36 is formed at one end of the power chamber at the junction line between the power chamber 32 and the extender chamber 34. A linkage member 38 is provided at the bottom of cylinder 30 for hingedly coupling the actuator to a desired machine. The cylinder body is shown as a single closed structure for simplicity of the drawing but in practice the cylinder would be assembled from individual parts in a conventional well-known manner. Ordinarily, fluidic actuators such as this one are mounted with the cylinder end secured to a fixed hinge point while the rod end is attached to the load. The nomenclature used herein reflects that configuration.

Figure 1:
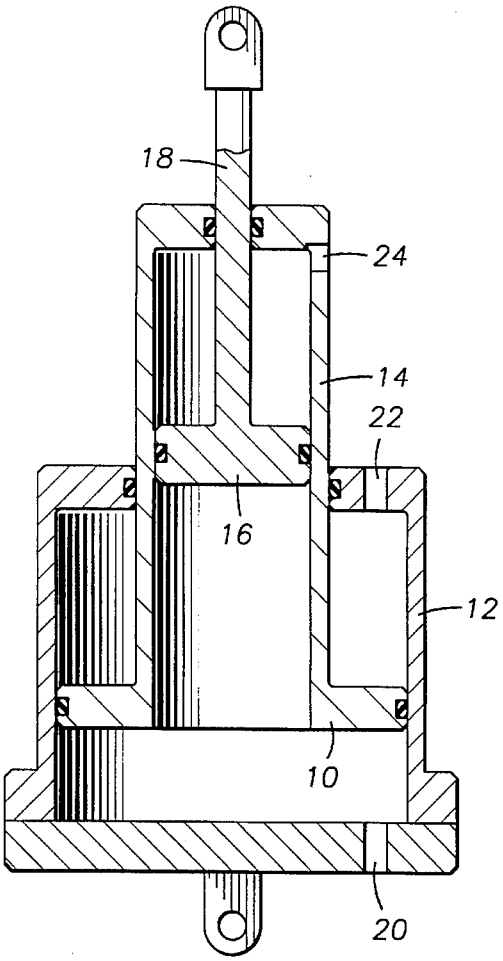
FIG. 1 (PRIOR ART)
FIG. 1 is a representation of a prior-art telescoping fluidic actuator.
Figure 4:
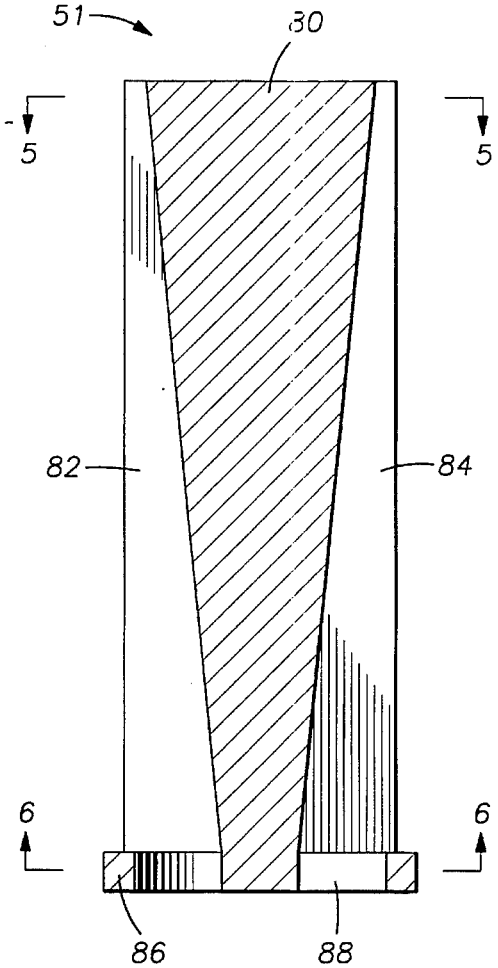
FIG. 4 is an exaggerated drawing of the throttling plunger.
Figure 5:
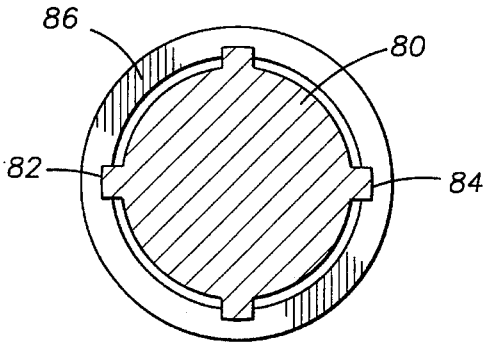
FIG. 5 is a cross section of the throttling plunger of FIG. 4 along lines 5—5.
Figure 6:
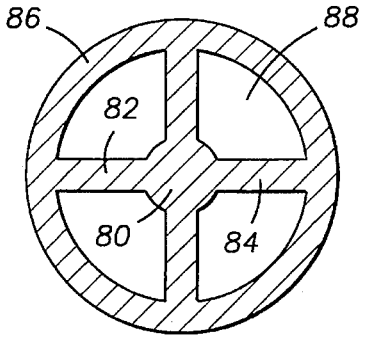
FIG. 6 is a cross section of the throttling plunger of FIG. 4 taken along lines 6—6.

A power piston generally shown as 40 is mounted for reciprocating motion within power chamber 32. The power piston has a diameter commensurate with the inner diameter of power chamber 32 but has a reduced portion 42 that reaches into a portion of extender chamber 34 even when power piston 40 is retracted. Power piston 40 defines a posterior face 44, an intermediate face 46 and an anterior face 48. A longitudinal bore 50 extends through the entire length of power piston 40. A spring-loaded throttling plunger 51, to be described later in conjunction with FIGS. 4–6, is slidingly mounted within longitudinal bore 50. Posterior face 44 is sealed from fluid communication with intermediate face 46 by and O-ring 52. Similarly, anterior face 48 is sealed from fluid communication with intermediate face 46 by O-ring 54.

An extender piston generally shown as 56, mounted for reciprocating motion independently of power piston 40 within extender chamber 34, has a diameter commensurate with the internal diameter of chamber 34. Extender piston defines a posterior face 58 and an anterior face 60 which are sealed from fluid communication with each other by an O-ring 61. Piston 56 is provided with a piston rod 62 having secured thereto an attachment lug 64. The interior of extender chamber 34 is sealed from the outside world by O-ring 66. As may be seen, posterior face 58 of extender piston 56 is exposed to anterior face 48 of power piston 40 and when the pistons are in the fully-retracted position, the two faces are in contact although they are shown slightly separated in FIG. 2 for clarity of illustration.

A first port 66 is installed in cylinder body 30 in fluid communication with the posterior face 44 of power piston 40. A second port 68 is provided in cylinder body 30 in fluid communication with anterior face 60 of extender piston 56. A breather port 70 is furnished to vent the volume within power chamber 32 that exists above intermediate face 46 of power piston 40. Venting may take place to the ambient atmosphere, to an accumulator or to a reservoir such as 72 as shown, depending upon the desired application.

Refer in addition now, to FIGS. 4–6. Bore 50 includes a reduced-diameter opening 81 subjacent to anterior face 48 of piston 40. A spring-loaded throttling plunger 51 is slidingly mounted within longitudinal bore 50. Throttling plunger 51 includes a tapered core 80 and a plurality of fins such as 82 and 84 as shown in FIG. 4 which is an enlarged side view of plunger 51. FIGS. 5 and 6 are top and bottom views respectively of the plunger 51. The diameter of the fins is commensurate with the diameter of opening 81. A ring member 86 forms the bottom of throttling plunger 51. The outer diameter of the ring member 86 conforms to the inner diameter of bore 50 but provides an interior circumferential opening around the base of the fins and tapered core 80 to allow fluid flow therethrough. A spring member 88, held in place by a spring clip 83, urges throttling plunger upwards to overcome sticktion when an extension cycle is initiated.

A schematic circuit diagram is shown for a conventional fluidic power circuit. A pump 90 provides fluid under pressure via 4-way manual or solenoid-actuated control valve 92. Fluid is drained to a reservoir such as 94.

In operation, assuming that pistons 40 and 56 are initially in the fully retracted position as shown in FIG. 2, pressurized fluid is applied by pump 90 against posterior face 44 of power piston 40 through the fluid inlet port 66. Pistons 40 and 56 are thereby caused to jointly move upwards until intermediate face 46 of piston 40 contacts shoulder 36 of power chamber 32 whereupon movement of piston 40 ceases.

At the end of the power stroke when intermediate face 46 of power piston 40 abuts shoulder 36, fluid continues to flow through bore 50 and ring opening 88 around fins 82 and 84 and through passageway 81 against posterior face 58 of extender piston 56. The applied fluid pressure now forces piston 56 to move upwards independently of power piston 40 to its limit of travel as shown in FIG. 3. Of course, during the extension stroke, fluid in extender chamber 34 is returned to reservoir 94 via port 68 in a conventional manner.

Both pistons are preferably retracted simultaneously by simply reversing the flow of fluid under pressure through port 68 against anterior face 60 of extender piston 56.

The initial application of fluid against the large area of the posterior face 44 favors increased mechanical thrust at the expense of stroke length and extension velocity. However, at the end of the power stroke, the actuator of this invention discretely re-apportions the distribution of energy to increase the stroke extension velocity vector but at the expense of the thrust vector.

Thus, the power piston and the extender pistons jointly execute an initial power stroke and the extender piston independently executes a subsequent extension stroke. In effect, the fluidic actuator optimizes the performance of a desired mechanical task by discretely apportioning the distribution of energy between the vectors of thrust and stoke velocity as a function of the stroke length during the performance of that task.

This arrangement also provides a safety feature in applications such as a fork lift. For a given system operating pressure, the load-lifting capacity of the actuator is limited by the discrete thrust exerted by a selected one of the pistons. Therefore, load that exceeds the capacity of the extender piston, can not be raised to a dangerous height that exceeds the stroke length of the power piston.

The bore 50 and spring-loaded throttling plunger 51 in power piston 40 provides a means for metering the fluid communication rate between posterior face 58 of extender piston 56 and posterior face 44 of piston 40. When intermediate face 46 of piston 40 abruptly contacts shoulder 36, due to the sudden decrease in effective piston diameter, unconstrained fluid flow into extender chamber 34 through longitudinal bore 50 in piston 40 could develop a runaway condition with respect to extender piston 56. The tapered core, 80, of plunger 51 initially restricts fluid flow to a desired volumetric rate. As flow continues and piston 56 extends, the flow rate is gradually increased in a safe incremental rate as plunger 51 is urged upwards under the influence of spring 89 and fluidic force against the lower face of ring 86. Thus, throttling plunger 51 meters the volumetric flow rate of fluid into extender chamber 34 as a function of the incremental stroke length of extender piston 56. The diameter of bore 50 and the taper of the core, 80, of throttling plunger 51 are sized such that, given a constant fluid flow into chamber 32, the extension velocity of extender piston 56 is constrained to remain within a desired limit.

The proportions of the piston diameters and the respective chamber lengths as shown in the Figures are exemplary only and are dimensioned to accommodate the service to which the actuator will be put. The actuating fluid may be air or other gas, oil, water or any other suitable fluid, compressible or substantially incompressible.

This invention has been described with a certain degree of specificity by way of example but not by way of limitation. Those skilled in the art will devise obvious variations to the examples given herein but which will fall within the scope and spirit of this invention which is limited only by the appended claims.

What is claimed is:

1. A two-stage fluidic actuator, comprising:

a dual-chamber cylinder body, said cylinder body including a power chamber having a first length that opens into a superjacent coaxial extender chamber having a second length that is greater than said first length, the internal diameter of said extender chamber being a pre-selected fraction of the internal diameter of said power chamber so that a shoulder is formed internally of the power chamber at the junction between the two chambers;

a power piston mounted for reciprocating motion in said power chamber, a reduced-diameter portion of the power piston reaching into a portion of said extender chamber, the power piston defining a posterior face and an intermediate face having diameters commensurate with the internal diameter of the power chamber, an anterior face having a diameter commensurate with the internal diameter of the extender chamber, the power piston having a longitudinal bore therethrough;

an extender piston including a piston rod adapted for reciprocating motion independently of said power piston, mounted in said extender chamber, said extender piston having posterior and anterior faces that are commensurate with the internal diameter of the extender chamber, the posterior face of the extender piston being exposed to the anterior face of the power piston;

means for inhibiting fluid communication between the posterior and the intermediate faces of said power piston, between the intermediate and the anterior faces of said power piston, and between the posterior and the anterior faces of said extender piston;

a spring-loaded throttling plunger slidingly mounted in said longitudinal bore for metering the volumetric flow rate of pressurized fluid therethrough against the posterior face of said extender piston as a function of the incremental stroke length thereof;

a first port in said cylinder body for providing fluid communication with the posterior face of the power piston;

a breather port in said cylinder body in fluid communication with the intermediate face of the power piston; and a second port in said cylinder body for providing fluid communication with the anterior face of the extender piston.

2. A method for causing the fluidic actuator, as defined by claim 1, to perform a desired task comprising the steps of:

causing said power piston and said extender piston to jointly execute an initial power stroke by applying a fluid under pressure through said first fluid communication port against the posterior face of the power piston to extend both said pistons until the intermediate face of the power piston abuts the shoulder at the junction between the power chamber and the extender chamber;

causing said extender piston to independently execute a subsequent extension stroke by continuing to apply fluid under pressure, through the longitudinal bore in the power piston, against the posterior face of said extender piston.

3. The method as defined by claim 2, comprising the step of:

retracting both said pistons by applying a fluid under pressure against the anterior face of said extender piston through said second fluid communication port.

4. The method as defined by claim 2, comprising the step of discretely apportioning the distribution of energy between the vectors of thrust and stroke velocity as a function of the stroke length to optimize the performance of saaid desired task.

5. A two-stage fluidic actuator, comprising:

a dual-chamber cylinder body, said cylinder body including a power chamber having a first length that opens into a superjacent coaxial extender chamber having a second length that is greater than said first length, the internal diameter of said extender chamber being a pre-selected fraction of the internal diameter of said power chamber;

a power piston mounted for reciprocating motion in said power chamber, a reduced-diameter portion of the power piston reaching into a portion of said extender chamber, the power piston defining posterior, intermediate and anterior faces and having a longitudinal bore therethrough;

an extender piston mounted in said extender chamber, said extender piston including a piston rod and adapted for executing reciprocating strokes of desired incremental lengths independently of said power piston, said extender piston having posterior and anterior faces, the posterior face of the extender piston being exposed to the anterior face of the power piston;

a spring-loaded throttling plunger slidingly mounted in said longitudinal bore for metering the volumetric flow rate of pressurized fluid therethrough against the posterior face of said extender piston as a function of the incremental stroke length thereof;

a first port in said cylinder body for providing fluid communication with the posterior face of the power piston;

a breather port in said cylinder body in fluid communication with the intermediate face of the power piston; and a second port in said cylinder body for providing fluid communication with the anterior face of the extender piston.

* * * * *